US005377849A

United States Patent [19]

Martin

[11] Patent Number: 5,377,849

[45] Date of Patent: Jan. 3, 1995

[54] SPORTS EQUIPMENT RACK

[76] Inventor: Harold G. Martin, 48360 Romeo Plank, Macomb Township, Macomb County, Mich. 48044

[21] Appl. No.: 48,425

[22] Filed: Apr. 14, 1993

[51] Int. Cl.[6] ..... A47F 5/00

[52] U.S. Cl. ..... 211/13; 211/182; 211/189; D6/552

[58] Field of Search ..... 211/182, 189, 13, 193, 211/196, 205, 33; 248/163.1, 165; D6/552, 462, 315, 327

[56] References Cited

U.S. PATENT DOCUMENTS

| | | | |
|---|---|---|---|
| 445,633 | 2/1891 | Becker . | |
| 1,033,630 | 7/1912 | Sowers | 211/182 X |
| 1,658,882 | 2/1928 | Cantrell et al. | 211/196 X |
| 2,084,854 | 6/1937 | McCarthy . | |
| 2,336,686 | 12/1943 | Hudash | 211/34 |
| 2,742,956 | 4/1956 | Cannata | 211/182 X |
| 3,310,180 | 3/1967 | Neagle . | |
| 3,589,522 | 6/1971 | Chiodo | 211/34 |
| 3,662,980 | 5/1972 | Kantor et al. | 211/182 X |
| 3,909,718 | 9/1975 | Allsop et al. . | |
| 4,627,544 | 12/1986 | Scarpa et al. | 211/182 X |
| 4,747,494 | 5/1988 | Tyson | 211/13 |
| 4,792,071 | 12/1988 | Scarpa et al. . | |
| 4,890,749 | 1/1990 | Walter | 211/182 X |
| 5,085,327 | 2/1992 | Mercer et al. | 211/13 |

*Primary Examiner*—Robert W. Gibson, Jr.
*Attorney, Agent, or Firm*—Brooks & Kushman

[57] ABSTRACT

A sports equipment rack for supporting various sports equipment worn by an athlete, particularly hockey and football equipment. The rack having a base member supporting a plurality of straight tubular pieces, right angle tubular pieces, and obtuse angle tubular pieces for supporting the equipment in spaced relationship to one another. The rack supporting the equipment to allow for a compact arrangement in which the wet sports equipment can be cleaned and dried and the equipment displayed in a way that mirrors where the equipment is used on the human body so that one can easily and quickly tell if all of his equipment is present. Further, the rack has a mechanism for transporting the rack without lifting it and enclosing the equipment and rack during transportation to shield the equipment from the elements.

18 Claims, 5 Drawing Sheets

SPORTS EQUIPMENT RACK

TECHNICAL FIELD

This invention relates generally to equipment racks and more particularly to racks for drying and displaying sports equipment.

BACKGROUND ART

In sports, especially contact sports such as hockey and football, a significant amount of equipment is worn by the athlete while participating in the athletic event. This equipment can become wet with rain or with the perspiration of the athlete. The need then arises to clean and dry this equipment. This is especially difficult for the participants in hockey and football in light of the fact that all of this equipment cannot easily be cleaned by throwing it in the washing machine and dryer. If the equipment is not cleaned and dried well soon after becoming wet, then mold and mildew will develop on the equipment with resulting unpleasant odors. Furthermore, there is the problem for athletes who wear the equipment every day or every other day and need the equipment to completely dry in these short time frames.

Clothing drying racks or clothes stands are common, such as drying racks disclosed in U.S. Pat. Nos. 445,633 to Becker and 2,084,854 to McCarthy, or clothes stands disclosed in U.S. Pat. No. 3,310,180 to Neagle. These racks, however, are not well adapted for drying sports equipment which is large and heavy and are not adapted at all for allowing the equipment to be cleaned the rack. Also, while some drying racks may possibly be adapted to support the equipment, the space requirements needed to have sufficient air circulation from all sides for each piece of equipment to facilitate the quick drying times needed to dry all of the equipment adequately on one of these racks would be excessive. This would result in equipment that is put too high up for a child athlete to fully reach all of the equipment or, in the alternative, the floor space needed would be excessive. Further, the excessive weight of this equipment may be too much for these racks to support. Conventional racks do not allow the participant to easily and quickly determine if he has all of his equipment on the rack. Nor do they allow the participant to quickly and easily take equipment off of the rack to dress and return it to the rack when finished dressing since the equipment would not be displayed in an easily organized and compact fashion. This is particularly true for children athletes since they often lose or forget equipment if it is not all kept organized and in one place. Moreover, the prior art racks do not allow for the equipment, while drying on these racks, to be arranged in a cosmetically appealing fashion.

Display racks, on the other hand, such as the display rack disclosed in U.S. Pat. No. 4,792,071 to Scarpa et al., while able to display clothing in a cosmetically appealing fashion, are not adapted to hold all of the large and heavy sports equipment and assure proper drying of each piece of equipment, even if this equipment could be displayed in an orderly fashion. Display racks may also utilize costly features not needed to properly dry and display the sports equipment. Nor are display racks constructed of materials which allow equipment to be cleaned while on the rack.

Further, the prior art racks and displays lack any means of easily moving them over long distances without carrying them. This can be very cumbersome, especially for individuals who wish to transport their equipment. Moreover, athletes would risk damage to the equipment because it would not be covered to protect it from the elements if transported out of doors on these racks.

DISCLOSURE OF INVENTION

This invention contemplates an improved equipment rack for supporting varied sports equipment in spaced relationship to each other provided with a plurality of straight tubular pieces, a plurality of right angle tubular pieces and a plurality of obtuse angle tubular pieces. The right angle tubular pieces cooperate with others of the straight tubular pieces to form vertical and horizontal supports for some of the equipment. Also, the obtuse angle tubular pieces cooperate with other of the straight tubular pieces to form angular supports for other of the equipment and to space such equipment by such angular supports. Further contemplated are a plurality of right angle T-pieces wherein the plurality of T-pieces cooperate with some of the straight tubular pieces and with additional straight tubular pieces to form an additional support spaced from the horizontal and vertical supports. Additionally contemplated is a base support member for supporting the rack, a mechanism for transporting the rack and equipment without having to carry it, and a means for covering the equipment and rack during transportation.

Accordingly, an object of this invention is to provide a sports equipment rack that is lightweight and compact and yet will support heavy and awkward equipment while allowing the equipment to dry in as short of a time as possible without having wet spots due to contact between the various pieces of equipment and poor air circulation around the various pieces of equipment.

A further object of this invention is to provide a sports equipment rack that can be transported with all of the equipment mounted on it without having to lift the rack and equipment.

Still further, an object of this invention is to provide an equipment rack having a protective covering which will enclose the equipment mounted thereon during transport to avoid exposing the equipment to the elements and thereby risking damage to the equipment.

An advantage of this invention is that a sports equipment rack is provided in which the equipment is displayed in an aesthetically appealing manner such that the athlete can quickly and easily determine if all of the desired equipment is present on the rack and he can easily take equipment from the rack and put it on or take it off and place it directly on the rack.

A feature of this invention is that an equipment rack is provided which is made of a water resistent material such that it can be easily cleaned by hosing it down and can also have the equipment mounted on the rack when it is hosed down to clean the equipment before allowing it to dry.

The above objects, features and advantages and other objects, features and advantages of the present invention are readily apparent from the following detailed description of the best mode for carrying out the invention when taken in connection with the accompanying drawings.

BEST MODE(S) FOR CARRYING OUT THE INVENTION

The embodiment shown in FIGS. 1–5 illustrates a sports equipment rack which is intended for use by individuals who wish to be able to clean, dry and transport varied equipment worn during various sporting events.

Figure 3:
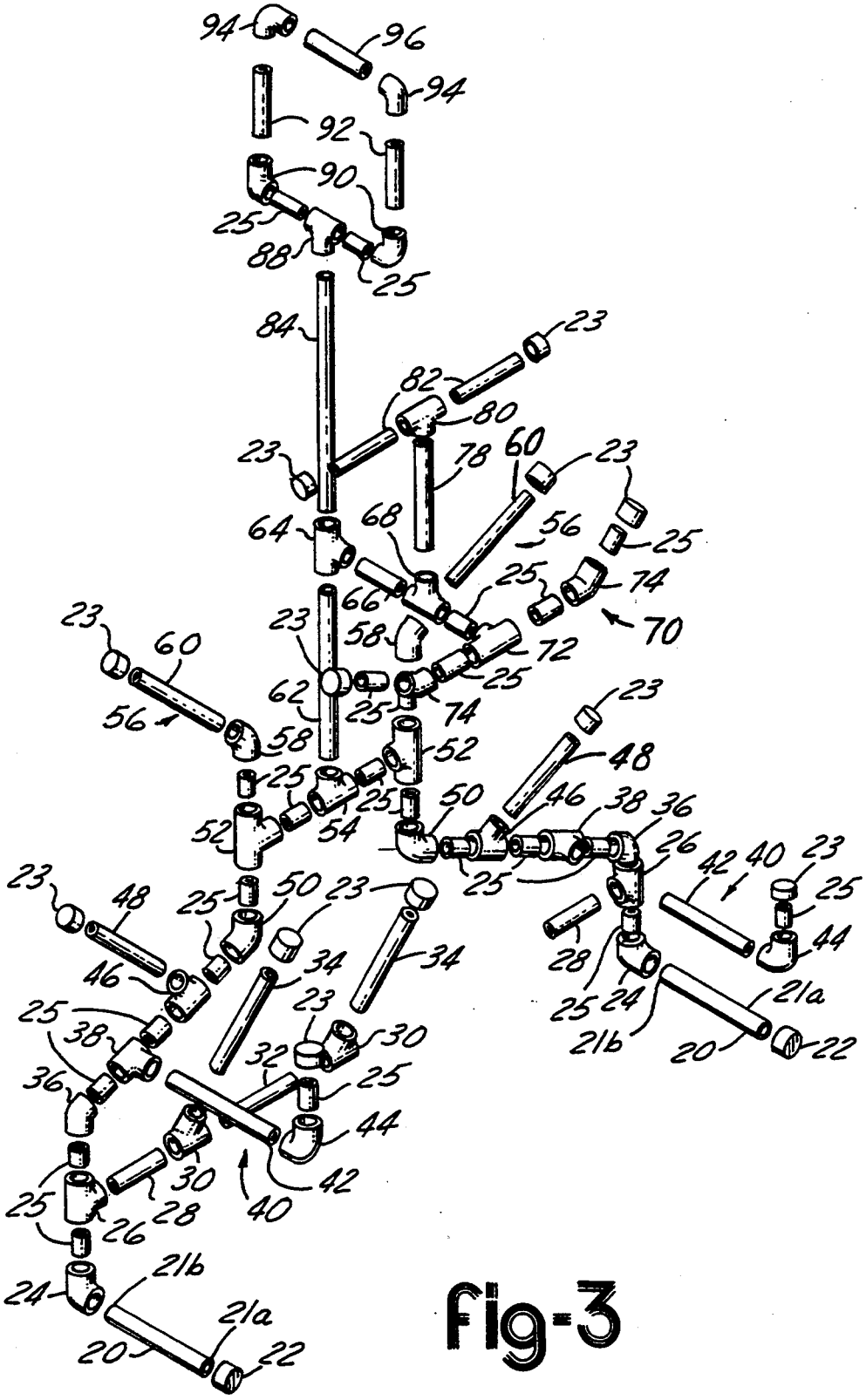
FIG. 3 is an exploded perspective view of the equipment rack in accordance with the present invention.

FIG. 3 illustrates the assembly of parts for the present invention when assembled from hollow plastic PVC pipe, although the parts can also be fabricated using I-beam sections, solid tubes or other similar beam shapes if so desired. These sections can also be made of suitable light weight corrosion resistant metal or treated wood if so desired. This configuration of the equipment rack is particularly arranged for supporting hockey equipment, but football and other sporting equipment could also be supported on a substantially similar configuration.

Figure 1:
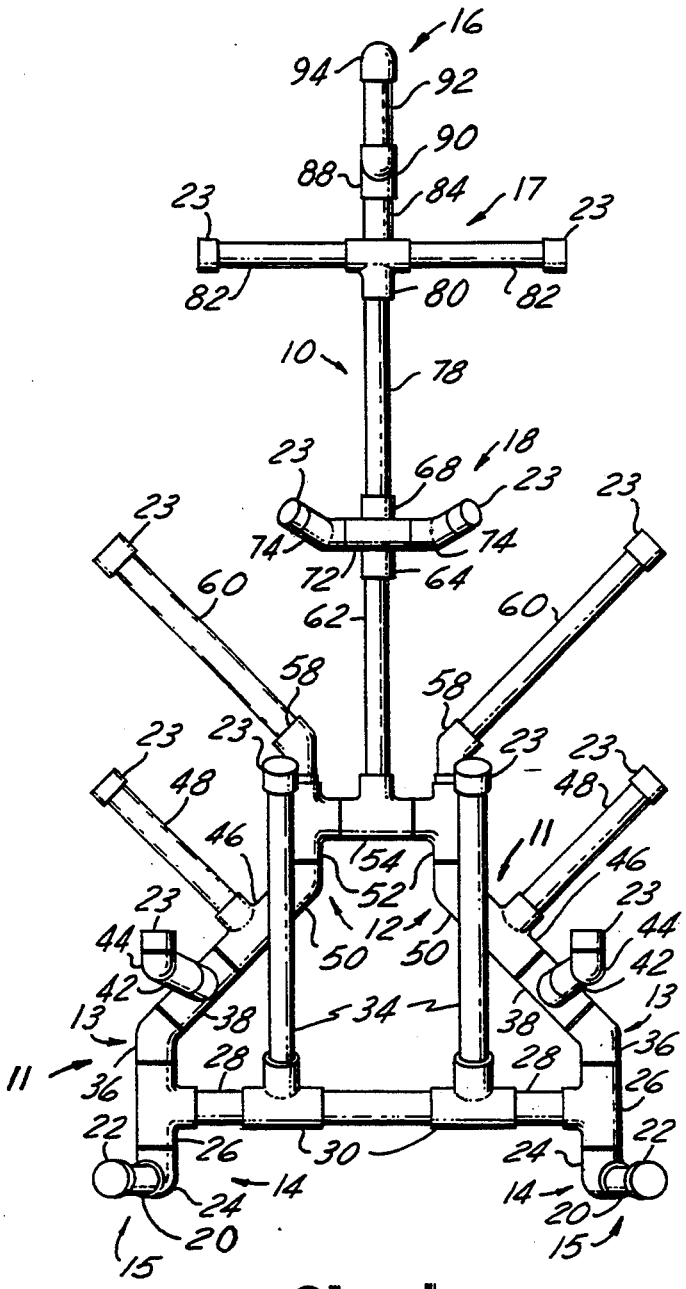
FIG. 1 is a front view of the equipment rack in accordance with the present invention.
Figure 4:
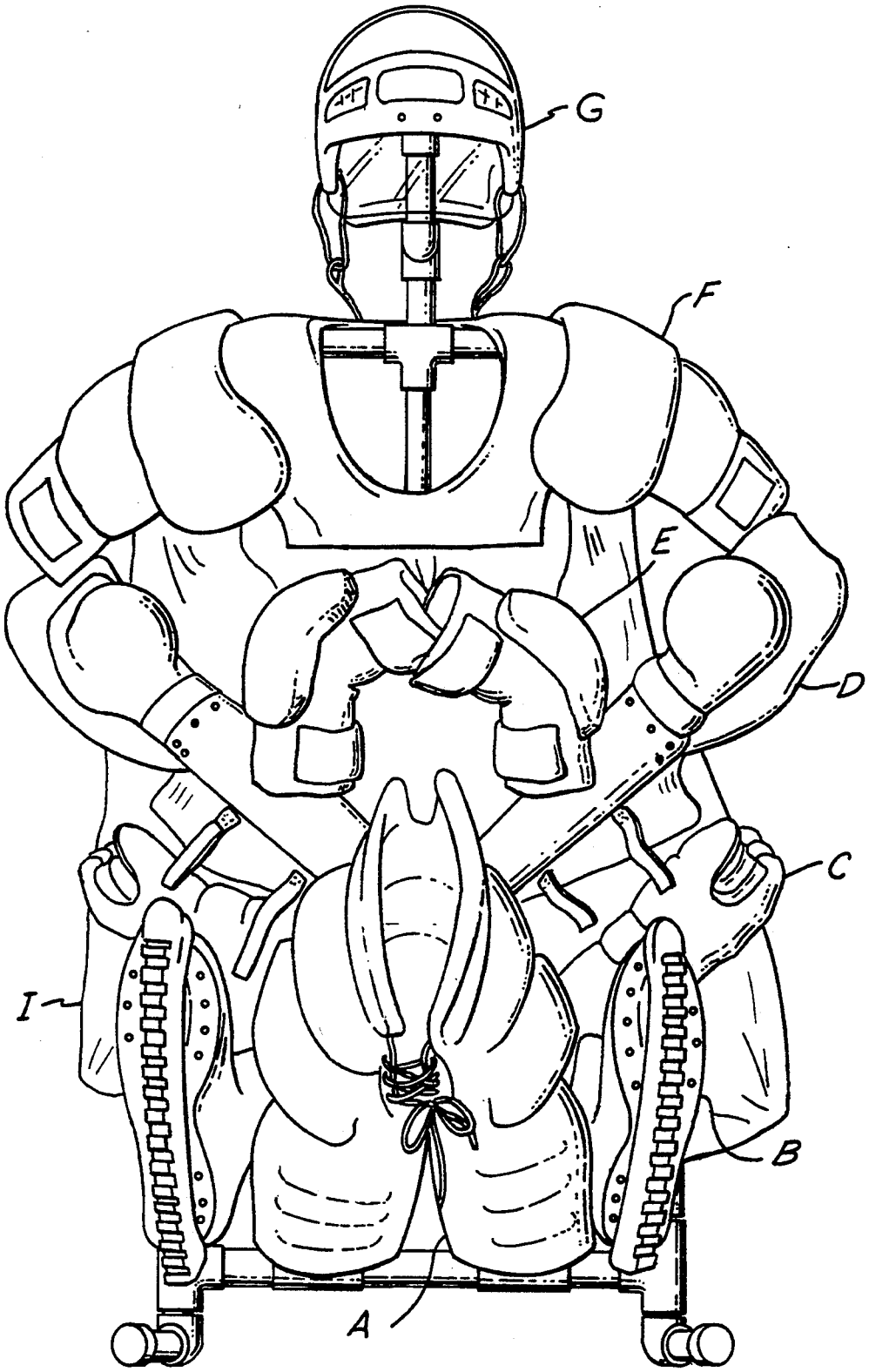
FIG. 4 is a front view of the equipment rack loaded with hockey equipment in accordance with the present invention.

As can be seen from FIGS. 1 and 4, the aesthetic appeal of the rack is partly from its design to hold the equipment in positions similar to those where it is worn on the human body. This assists an individual in determining whether or not all of the equipment needed is present and which makes it easy for an athlete to remove the equipment from the rack to dress and return it back to the rack after use for drying. The rack has a general stanchion 10 forming the back of the rack, which splits at its lower end into two legs 11 having joints forming hips 12, knees 13, ankles 14, and connecting to feet 15. The stanchion 10 has a head 16 mounted on top of it and arm members which generally form shoulders 17 and elbows 18 located midway along it. The various supports for the equipment then protrude from this basic structural shape. This configuration also allows for the various pieces of equipment to be spaced sufficiently apart from one another to ensure proper circulation of air for drying. The details of the specific elements used to create this rack are discussed below.

Figure 2:
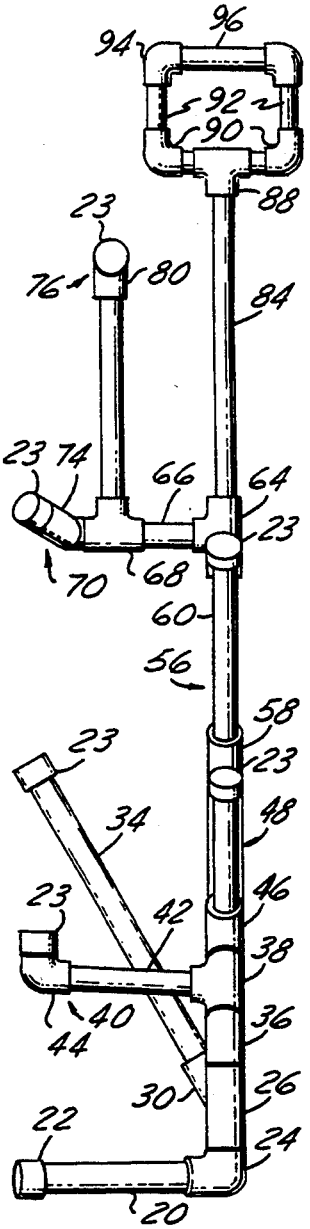
FIG. 2 is a side elevation view of the equipment rack in accordance with the present invention.
Figure 5:
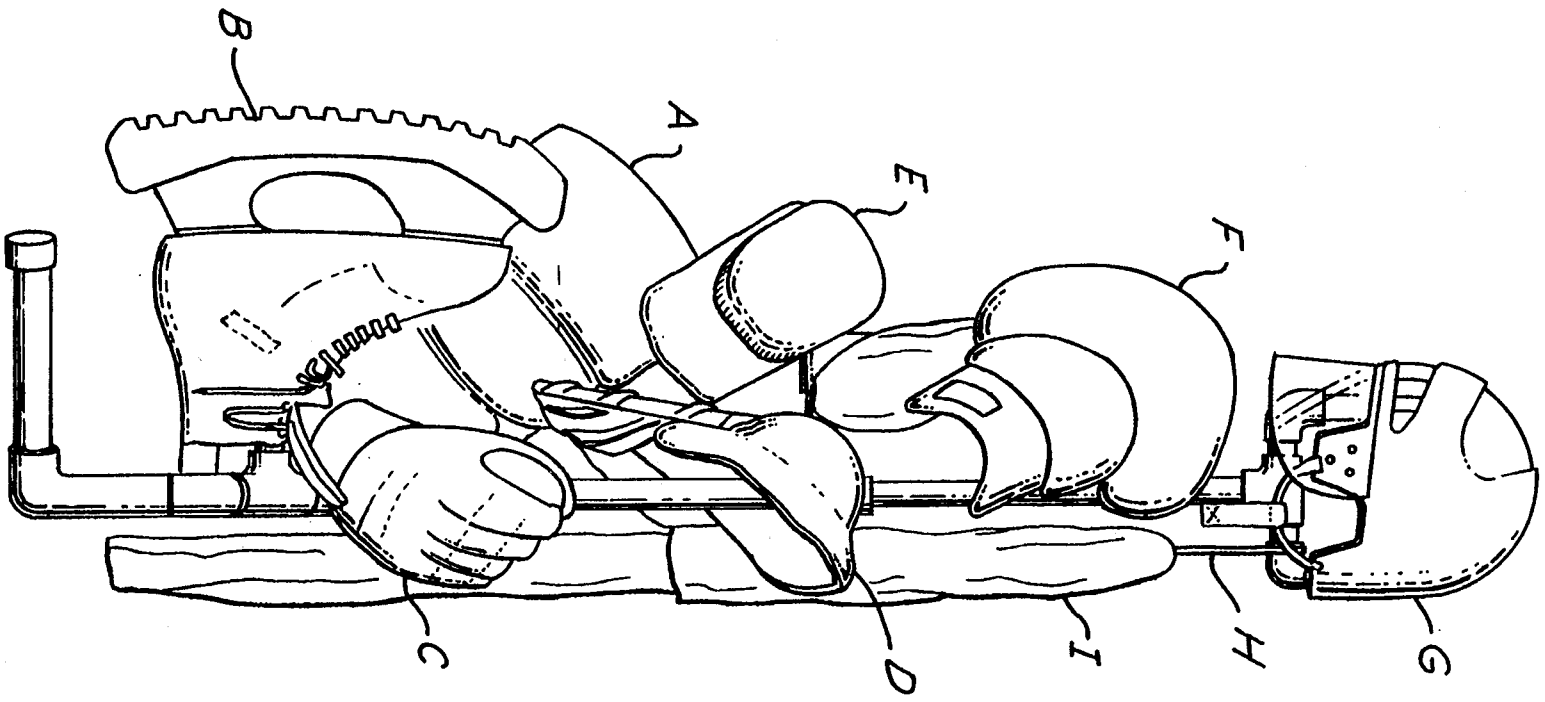
FIG. 5 is a side elevational view of the equipment rack loaded with hockey equipment in accordance with the present invention.
Figure 6:
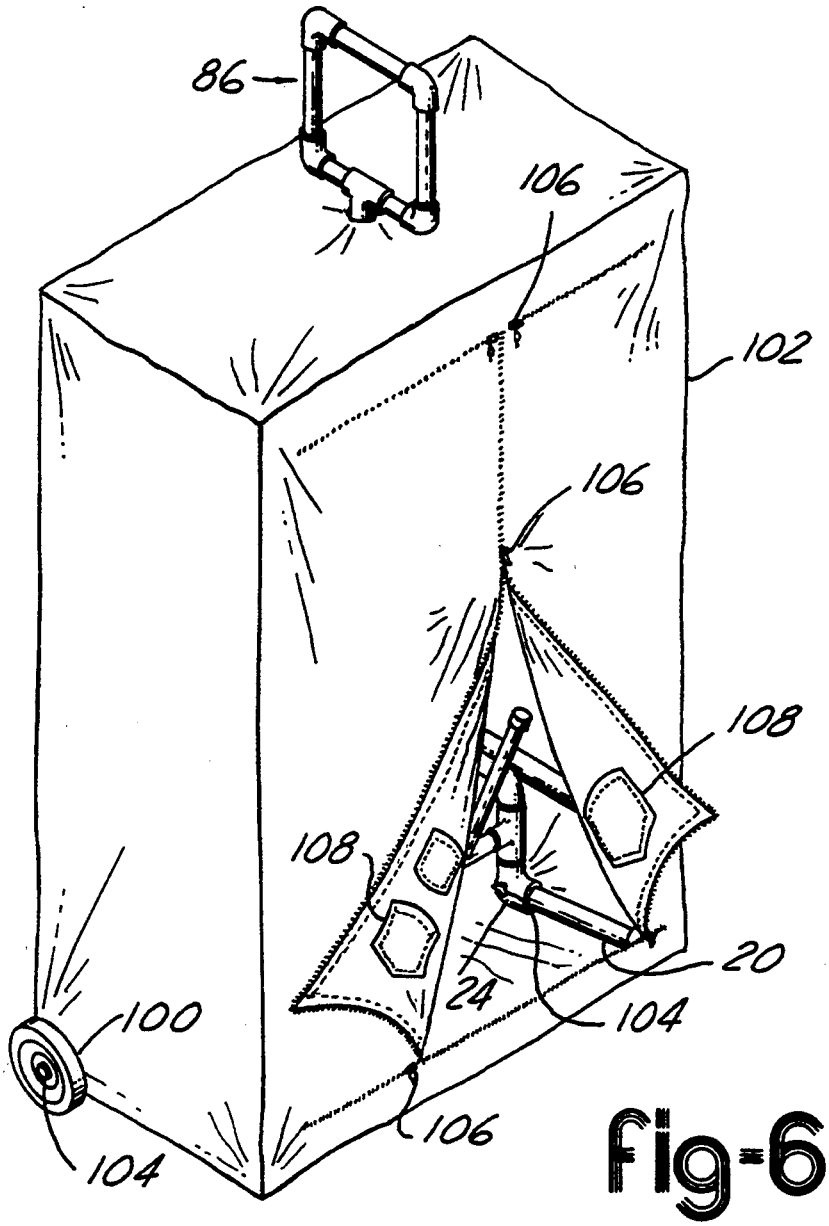
FIG. 6 is a perspective view of an alternative embodiment of the equipment rack in accordance with the present invention.

In the embodiment illustrated in FIGS. 1 to 3, an equipment rack is designed for supporting sports equipment worn by an athlete. FIGS. 4 and 5 illustrate this particular embodiment of the invention when loaded with hockey equipment. The equipment rack has two support legs 20 which are made to lay horizontally and generally parallel on a flat surface, such as a floor, for supporting the overall structure and equipment while still remaining stable. This number of legs 20 could be more, if desired for stability reasons, and need not necessarily be parallel so long as the rack will be stable. A first end 21*a* of each of the support legs 20 is enclosed by a cap 22 in order to avoid snagging anything on the open end of the pipe. This is done throughout the structure for the same purpose with similar caps 23. The pipes could also be fabricated with integral ends or open ends that are sanded smooth to accomplish the same purpose, although the caps are preferred in order to avoid the possibility that children will get their fingers caught in the ends of the pipes.

A second end 21*b* of each of the support legs 20 is connected to a first one of two sockets in a first 90° elbow piece 24 using glue. These connections may also be accomplished using threaded pieces that are screwed together, pinned together, have a snug slip-in fit, or use slip lock hinges rather than glue in order to allow for ease of assembly and disassembly. Further, some of the pieces disclosed herein can be fabricated as a single piece rather than being manufactured as the separate pieces disclosed in the present embodiment.

A second socket of each of the first 90° elbow pieces 24 is connected to a first of three sockets in first T-piece 26. This connection is accomplished using short connector pieces 25 between the first elbow pieces 24 and the first T-pieces 26. These types of connector pieces 25 are also used for other socket connections as shown in FIG. 3. Protruding horizontally from each of the first T-pieces 26 is a first straight piece 28 connected to it at a second socket. Each first straight piece 28 has an additional second T-piece 30 connected to its other end and a single horizontal second straight piece 32 connecting to a second socket of the two second T-pieces 30. Protruding from a third socket of each of the two second T-pieces 30, forward and at an upward angle of approximately 60° from horizontal, is a hip/thigh pad member 34. The member 34 supports the athlete's hip/-thigh pads A when placed on it, as well as holding them away from other equipment. This minimizes contact which allows them to dry properly, i.e., minimal contact allows the equipment to dry without wet spots on the equipment due to contact between various pieces of equipment. It also separates the equipment sufficiently to allow good air circulation around the equipment to further enhance drying.

Connected one each to a third socket of each of the first T-pieces 26 are first sockets of first 45° elbow pieces 36, angled inward towards each other. Connected one each to a second socket of each of these first 45° elbow pieces 36 are first sockets of third T-pieces 38. Protruding from each of the third T-pieces 38 forward and at a slight upward angle from horizontal is a footwear support member 40, in this case for supporting ice skates B. These members 40 are made up of a third straight piece 42, connected to a second socket of the third T-piece 38 at a first end and a first socket of a second 90° elbow piece 44 connected at a second end. This member will support the athlete's ice skates B while keeping them from resting on other equipment.

Connected to a third socket of each of the third T-pieces 38 is a first socket of a fourth T-piece 46. The fourth T-piece 46 has a glove support member 48 protruding from a second socket, to the side and at and upward angle of about 45° from horizontal, which supports the athlete's gloves C while keeping the gloves C from resting on other equipment.

Connected one each to third sockets of the fourth T-pieces 46 are first sockets of second 45° elbow pieces 50. Additionally, connected one each to second sockets of the second 45° elbow pieces 50 are first sockets of fifth T-pieces 52, with a single sixth T-piece 54 connected horizontally between second sockets of the two fifth T-pieces 52. Protruding from each third socket of the fifth T-pieces 52 are shin pad support members 56. The shin pad support members 56 are made up of two third 45° elbow pieces 58, one each connected to the fifth T-pieces 52, and a fourth straight piece 60, one each connected to a second socket of the third 45° elbow piece 58, such that the shin pad support member 56 protrudes at about a 45° angle from the horizontal, approximately parallel to the glove support member 48. The shin pad support members 56 each support a shin pad D while minimizing contact between the shin pads D and other equipment.

Vertically protruding from a third socket of the sixth T-piece 54 is a fifth straight piece 62. This piece, in turn, is connected at its other end to a first socket of a seventh T-piece 64. Connected to a second socket of the seventh T-piece 64 is a first end of a sixth straight piece 66 which protrudes horizontally in the forward direction, and connected to the other end of the sixth straight piece 66 is a first socket of an eighth T-piece 68. Protruding forward from the eighth T-piece 68 is an elbow pads support member 70 for supporting a pair of elbow pads E while maintaining minimum contact between the elbow pads E and the other equipment. This support member is made up of a ninth T-piece 72 connected to a second socket of the eighth T-piece 68 and two fourth 45° elbow pieces 74 protruding to the side and upward from opposite sockets of the eighth T-piece 68. Also, protruding vertically from a third socket of the eighth T-piece 68, is a shoulder pads support member 76, for supporting shoulder pads F while maintaining minimum contact between the shoulder pads F and the other equipment. The shoulder pads support member 76 is made up of a seventh straight piece 78 connected at one end to a third socket of the eighth T-piece 68 and at the other end to a first socket of a tenth T-piece 80. The tenth T-piece 80 is, in turn, connected to two eighth straight pieces 82 which protrude, horizontally in a side-to-side direction, from opposite sockets of the tenth T-piece 80.

Additionally, connected to a third socket of the seventh T-piece 64 is a ninth straight piece 84, protruding in the generally vertical direction. Protruding from the opposite end of the ninth straight piece 84 is a helmet support member 86 which supports a helmet G and also can support a hanger H for a jersey I or pants (not shown) which allows them to hang on the back side of the rack. The helmet support member 86 is comprised of an eleventh T-piece 88 connected by its first socket to the other end of the ninth straight piece 84; a pair of third 90° elbow pieces 90 connected by first sockets to opposite sockets of the eleventh T-piece 88; a pair of tenth straight pieces 92, one each connected at a second socket of the third 90° elbow pieces 90, extending in the vertical direction; a pair of fourth 90° elbow pieces 94 one each connected at their first sockets to the other end of the tenth straight pieces 92; and an eleventh straight piece 96 connected between second sockets of the fourth 90° elbow pieces 94 to form a generally rectangular-shaped helmet support member 86.

The overall rack, therefore, provides for an aesthetically pleasing arrangement of the equipment in which the person can quickly and easily determine if all of his equipment is on the rack. The athlete can easily take equipment from the rack to put it on since each piece has a specific location on which it is mounted and in which the total configuration uses a minimal amount of floor space and height yet each piece will fully dry in as short of a time as possible.

An alternative embodiment is illustrated in FIG. 4 in which the rack has two wheels 100 attached to the bottom of the rack by providing a pair of parallel horizontal bores through each of the first 90° elbow pieces and attaching the wheels 100 using a nut, bolt and washer combination 104 or similar attachment means which allows the wheels to freely rotate. This allows for mobility of the rack and equipment without having to lift the rack. Low friction skids may also be used in place of the wheels 100 to provide mobility of the rack. For this embodiment, the first 90° elbow pieces 24 can be substituted with elbow pieces of greater than 90° such that the stand will rest on the front of the support legs 20 and the wheels 100 while maintaining the vertical portions of the rack perpendicular to the floor.

Additionally, the rack can be enclosed in a removable cover 102 for transportation or other purposes if the athlete desires to transport his equipment to an athletic event while still on the rack. The cover 102 is made of vinyl, or other similar water repellant material, surrounding the equipment and rack and has openings, for removing the equipment and also for allowing the equipment to dry, which close using zippers 106, "Velcro," snaps or similar fastening means. Further, the cover 102 can have the helmet support member 86 protruding from it to use as a handle during transportation, or the cover 102 can have handles built into it. The cover 102 can also have pockets 108 or the like to hold the helmet and any other articles the athlete may wish to transport to the sporting event.

In a third alternative embodiment, the elbow pads support member 70, shin pads support member 56 and glove support members 48 are removably connected, by using pins or slip-in fit, allowing for their removal to convert the rack into a rack for use primarily with football equipment.

A further alternative embodiment provides for the support legs 20, skate support members 40 and the sixth straight piece 66, which protrude forward out from the main portion of the rack, to be either removable or hinged allowing the rack to be easily disassembled and thereby minimize space for ease of shipping, transportation or storage when the rack is not in use.

Although particular embodiments of the present invention have been illustrated in the accompanying drawings and described in the foregoing detailed description, it is to by understood that the present invention is not to be limited to just the embodiments disclosed. For example, The first T-piece 26, the first and second 45° elbow pieces 36, the third and fourth T-pieces 38, 46, and the fifth T-piece 52 could also be fabricated as a single dog-legged piece for assembly into the overall rack, or other parts could be fabricated as single pieces to minimize the number of overall parts in the assembly. Accordingly, numerous rearrangements, modifications and substitutions are possible without departing from the scope of the claims hereafter.

We claim:

1. An improved rack for supporting varied sports equipment in spaced relationship to each other, the rack comprising:

a plurality of straight tubular pieces;

a plurality of right angle tubular pieces, the right angle tubular pieces cooperating with some of the straight tubular pieces to form vertical and horizontal supports for some of the equipment; and a plurality of obtuse angle tubular pieces, the obtuse angle tubular pieces cooperating with others of the straight tubular pieces to form angular supports for others of the equipment and to space such equipment by such angular supports.

2. The improved sports rack of claim 1 wherein the tubular pieces have a uniform cross-sectional shape.

3. The improved rack of claim 1 wherein a pair of the right angle pieces cooperate with a pair of the straight tubular pieces to form a base for said rack.

4. The improved rack of claim 1 for supporting varied sports equipment which may include a helmet and wherein pairs of right angle tubular pieces cooperate with pairs of straight tubular pieces to form a polygonal configuration adapted to support said helmet in an upright position.

5. The improved rack of claim 1 including a plurality of right angle T-pieces, and wherein the plurality of T-pieces cooperate with some of the straight tubular pieces and with additional straight tubular pieces to form an additional support spaced from said horizontal and vertical supports.

6. The improved rack of claim 1 wherein the plurality of straight tubular pieces, the plurality of right angle tubular pieces and the plurality of obtuse angle tubular pieces have the cross-sectional shape of a hollow tube.

7. The improved rack of claim 1 wherein the plurality of straight tubular pieces, the plurality of right angle tubular pieces and the plurality of obtuse angle tubular pieces have a circular cross-sectional shape.

8. The improved rack of claim 1 wherein the tubular pieces are made of plastic.

9. The improved rack of claim 1 wherein the rack further comprises transportation means for moving the rack whereby the rack can be transported without lifting it.

10. The improved rack of claim 1 wherein the rack further comprises means for removably enclosing the equipment whereby the equipment will be shielded from outside elements.

11. A sports equipment rack for supporting varied sports equipment in spaced relationship to each other, the rack comprising:

base means for supporting the rack;

two lower dog-leg shaped support members having a lower vertical portion, an upper vertical portion and a middle angled portion therebetween, each of the portions having an upper end, lower end and a mid-section therebetween, the lower end of the lower vertical support portions mounted to the base means;

a lower horizontal support member having two ends and a mid-section therebetween, each end connected to a different one of the dog-leg support member lower vertical portion mid-sections;

an intermediate horizontal support member having two ends and a mid-section therebetween, each end connected to a different one of the dog-leg support member upper vertical portion mid-sections;

an upper vertical support member having an upper end, a lower end and a mid-section therebetween, the lower end mounted to the intermediate horizontal support member mid-section; and an upper horizontal support member having two ends and a mid-section therebetween, one of the two ends mounted to the upper vertical support member mid-section.

12. The sports equipment rack of claim 11 further including:

a helmet support member mounted to the upper end of the upper vertical support portion whereby the helmet support member will support a helmet placed upon it;

shoulder pad means for supporting a pair of shoulder pads with minimal contact between the pair of shoulder pads and the other sports equipment mounted on the rack, the shoulder pad means mounted to the upper horizontal support member mid-section;

hip/thigh pad means for supporting a pair of hip/-thigh pads with minimal contact between the hip/-thigh pads and the other sports equipment mounted on the rack, the hip/thigh pad means mounted to the mid-section of the lower horizontal support member; and foot gear means for supporting foot gear with minimal contact between the foot gear and the other sports equipment mounted on the rack, the foot gear means mounted to the mid-section of the middle angled portion.

13. The sports equipment rack of claim 12 wherein the rack is further comprised of:

elbow pad means for supporting a pair of elbow pads, the elbow pad means mounted to the opposite end of the upper horizontal support member from the upper vertical support member whereby minimal contact between the pair of elbow pads and the other sports equipment mounted on the rack is maintained;

shin pad means for supporting a pair of shin pads with minimal contact between the pair of shin pads and the other sports equipment mounted on the rack, the shin pad means mounted to the upper end of the upper vertical support portion; and glove means for supporting a pair of gloves with minimal contact between the pair of gloves and the other sports equipment mounted on the rack, the glove means mounted to the mid-section of the angled support portion.

14. The sports equipment rack of claim 13 wherein the rack is further comprised of:

means for removably securing the foot gear means, base means, elbow pad means and shoulder pad means to thereby reduce the overall volume of the rack for storage or transportation.

15. The sports equipment rack of claim 11 wherein the support means is comprised of a plurality of support legs protruding in a substantially horizontal direction and transportation means for moving the rack without lifting it.

16. The sports equipment rack of claim 11 wherein the equipment rack is further comprised of means for enclosing the entire equipment rack and the varied equipment within a moisture repellant outer layer whereby the equipment is removable from the enclosing means.

17. An improved rack for supporting varied sports equipment in spaced relationship to each other, the rack comprising:

a central stanchion member located in a generally vertical plane, the central stanchion member having an upper and a lower end and a mid-section therebetween;

a pair of leg members having a plurality of joints forming hips, knees and ankles, the leg members coupled to the lower end of the central stanchion;

a pair of feet members coupled one each to the pair of leg members whereby the feet members support the rack;

a head member mounted to the upper end of the stanchion member;

arm members mounted to the stanchion member proximate the upper end and forming a shoulder portion and an elbow portion, whereby some of the varied sports equipment will be supported on the rack; and a plurality of support members coupled to the leg members and arm members for supporting some other of the varied sports equipment.

18. An improved rack for supporting varied sports equipment in spaced relationship to each other, rack comprising:

a central stanchion member located in a generally vertical plane, the central stanchion member having an upper and a lower end and a mid-section therebetween;

a pair of leg members having a plurality of joints forming hips, knees and ankles, the leg members coupled to the lower end of the central stanchion;

a pair of feet members coupled one each to the pair of leg members whereby the feet members support the rack;

a head member mounted to the upper end of the stanchion member;

arm members mounted to the stanchion member proximate the upper end and forming a shoulder portion and an elbow portion, whereby some of the varied sports equipment will be supported on the rack; and means for removably enclosing the varied sports equipment and rack whereby the equipment will not be shielded from outside elements.

* * * * *